US008495804B2

(12) United States Patent
Scicluna et al.

(10) Patent No.: US 8,495,804 B2
(45) Date of Patent: Jul. 30, 2013

(54) QUICK-RELEASE BUCKLE FOR A SHOULDER STRAP AND PREVENTING UNINTENTIONAL RELEASE WHEN TENSION IS EXERTED BY THE SHOULDER STRAP

(75) Inventors: Paul V. Scicluna, Penndel, PA (US); Victor Sanz, Whitehouse Station, NJ (US)

(73) Assignee: Tumi, Inc., South Plainfield, NJ (US)

( * ) Notice: Subject to any disclaimer, the term of this patent is extended or adjusted under 35 U.S.C. 154(b) by 356 days.

(21) Appl. No.: 12/800,722

(22) Filed: May 21, 2010

(65) Prior Publication Data

US 2011/0283495 A1 Nov. 24, 2011

(51) Int. Cl.
*A44B 11/26* (2006.01)

(52) U.S. Cl.
USPC ..... 24/606; 24/DIG. 51; 24/630; 24/614; 24/625; 24/588.12; 24/667; 24/DIG. 42

(58) Field of Classification Search
None
See application file for complete search history.

(56) References Cited

U.S. PATENT DOCUMENTS

| | | | | |
|---|---|---|---|---|
| 4,385,424 A | | 5/1983 | Petersen, III | |
| 4,413,383 A | * | 11/1983 | Spalding | 24/164 |
| 4,977,650 A | | 12/1990 | Ida | |
| 5,224,247 A | * | 7/1993 | Collier | 24/587.12 |
| 5,551,131 A | | 9/1996 | Anscher | |
| 5,855,057 A | | 1/1999 | Anscher | |
| 6,000,109 A | | 12/1999 | Anscher | |
| 6,141,841 A | * | 11/2000 | Workman | 24/701 |
| 6,704,977 B1 | * | 3/2004 | Chung | 24/588.12 |
| 6,931,695 B2 | | 8/2005 | Anscher | |
| 2007/0214617 A1 | | 9/2007 | Niwa | |

FOREIGN PATENT DOCUMENTS

| | | |
|---|---|---|
| EP | 0 492 221 | 7/1992 |
| WO | WO 2005/013750 | 2/2005 |

* cited by examiner

*Primary Examiner* — Jack W. Lavinder
(74) *Attorney, Agent, or Firm* — Jon Fallon, Esq.

(57) ABSTRACT

A quick-release buckle for a shoulder strap and preventing unintentional release when tension exerted by the shoulder strap. The buckle includes a socket member, a plug member, and a locking member. The plug member has the shoulder strap connected thereto, and is replaceably engaged with the socket member. The locking member is an operative part of the socket member. The plug member replaceably engages in the locking member in such a manner so to be released therefrom, the locking member is released and the plug member has to be pulled in a direction opposite to that in which tension from the shoulder strap is exerted so as to prevent the unintentional release of the quick-release buckle when the tension is exerted by shoulder strap, while the tension exerted by the shoulder strap when the plug member is engaged in the locking member assures unintentional release of the quick-release buckle.

12 Claims, 6 Drawing Sheets

QUICK-RELEASE BUCKLE FOR A SHOULDER STRAP AND PREVENTING UNINTENTIONAL RELEASE WHEN TENSION IS EXERTED BY THE SHOULDER STRAP

1. BACKGROUND OF THE INVENTION

A. Field of the Invention.

The embodiments of the present invention relate to a quick-release buckle, and more particularly, the embodiments of the present invention relate to a quick-release buckle for a shoulder strap and preventing unintentional release when tension is exerted by the shoulder strap.

B. Description of the Prior Art.

Plug and socket type buckles are useful for connecting two ends of a strap together on various articles, such as luggage and outerwear. These types of buckles have a plug member connected to one end of a strap and a socket member connected to an end of a second strap. The straps are connected by locking the plug into the socket. Typically, these plug and socket type buckles have a way of easily releasing the plug from the socket, such as by a center push button on the socket.

These buckles enable the user to easily lock and unlock two straps together. They all suffer, however, from the drawback of insufficient strength under high degrees of tension. Excessive pressure on the buckle from a strap being pulled can cause the buckle to inadvertently release.

Thus, there exists a need for a quick-release buckle for a shoulder strap and preventing unintentional release when tension is exerted by the shoulder strap.

Numerous innovations for quick-release buckles have been provided in the prior art, which will be described below in chronological order to show advancement in the art, and which are incorporated herein by reference thereto. Even though these innovations may be suitable for the individual purposes to which they address, nevertheless, they differ from the present invention in that they do not teach a quick-release buckle for a shoulder strap and preventing unintentional release when tension is exerted by the shoulder strap.

(1) U.S. Pat. No. 4,385,424 to Petersen, III.

U.S. Pat. No. 4,385,424 issued to Petersen, III on May 31, 1983 in U.S. class 24 and subclass 230 A teaches a safety belt buckle including a frame detachably coupled with a belt tongue, wherein each is secured to the end of a belt. The tongue has a latch opening. The frame has a reaction flange for pivotal engagement with a latch lever having a projection formed for displaceable engagement and disengagement in the latch opening. A plastic housing within the frame is recessed to accommodate the lever, to cooperate with the frame to guide the tongue, and to provide spring reaction apparatus for a push button spring mounted on a displaced integral push button seat formed in the lever. A cover with an access opening for the push button completes the assembly of the frame, the lever, the housing, and the push button spring elements.

(2) U.S. Pat. No. 4,977,650 to Ida.

U.S. Pat. No. 4,977,650 issued to Ida on Dec. 18, 1990 in U.S. class 24 and subclass 614 teaches a buckle including a plug having a protuberant arm with first engaging apparatus, and a socket adapted to be releasably coupled with the plug. The lower wall of the socket has a cantilevered engaging flap provided on the inner surface thereof and has second engaging apparatus for snapping engagement with the first engaging apparatus for coupling of the plug and the socket. The upper wall of the socket has a cantilevered resilient presser flap overhanding the cantilevered engaging flap and being yieldable downwardly to thus depress the resilient engaging flap, thereby bringing the second locking apparatus out of engagement with the first engaging apparatus of the protuberant arm for uncoupling the plug from the socket. The buckle further includes a locking plate slidably mounted on the presser flap for reciprocation between its locking position and its unlocking position.

(3) European Patent Application Number 0 492 221 A2 to Shima et al.

European Patent Application Number 0 492 221 A2 published to Shima et al. on Jul. 1, 1992 in international class A44B and subclass 11/25 teaches a buckle for connecting opposite ends of a belt or the like. The buckle includes a plug member and a socket member releasably engageable therewith. The socket member has a central through opening for accommodating a locking member and a spring member that has a plurality of integrally formed, strip-like spring elements arranged to provide uniform distribution of pressure over the locking member.

(4) U.S. Pat. No. 5,551,131 to Anscher.

U.S. Pat. No. 5,551,131 issued to Anscher on Sep. 3, 1996 in U.S. class 24 and subclass 614 teaches a multiple-piece buckle having a socket member and at least one plug member. The plug member has a resilient tongue with a pair of laterally projecting wings or latches near a distal end thereof. The socket member includes a pair of lugs that are adapted to engage the latches to lock the plug member into the socket member. The socket member includes a hinged plate or button in a top face thereof, which can be depressed to force the wings of the resilient tongue of the plug member away from the lugs to release the wings so as to disengage the buckle.

(5) U.S. Pat. No. 5,855,057 to Anscher.

U.S. Pat. No. 5,855,057 issued to Anscher on Jan. 5, 1999 in U.S. class 24 and subclass 614 teaches a plug and socket-type buckle assembly in which the plug portion includes a base and a flexible plate integrally formed therewith. A locking lug extends across the free end of the plate and protrudes above and below the flat surfaces of the plate. The socket portion includes a top part and a bottom part integrally formed therewith to define a cavity for receiving the plug portion. The top part has a flexible release button integrally formed therewith, with a downwardly projecting tip. There is at least one projecting ledge disposed on the inside surface of the top part for engaging one side of the locking lug when the plug portion is inserted in the socket portion. A flexible tongue is integrally formed with the bottom part, and has apparatus for engaging an opposite side of the locking lug when the plug portion is inserted in the socket portion. Downward pressure on the release button when the plug portion is inserted in the socket portion disengages the locking lug from the projecting ledge. Further pressure on the release button causes the tip of the release button to bend the flexible tongue and release the locking lug from the flexible tongue to remove the plug portion from the socket portion.

(6) U.S. Pat. No. 6,000,109 to Anscher.

U.S. Pat. No. 6,000,109 issued to Anscher on Dec. 14, 1999 in U.S. class 24 and subclass 614 teaches a plug and socket-type buckle assembly in which the plug portion includes a base and a flexible plate integrally formed therewith. There is at least one aperture in the plate. A locking lug extends across the free end of the bottom of the plate, and protrudes below the flat surfaces of the plate. The socket portion includes a top part and a bottom part integrally formed therewith to define a cavity for receiving the plug portion. The top part has a flexible release button integrally formed therewith, and having a downwardly projecting tip. At least one projecting ledge is disposed on the inside surface of the top part for engaging the aperture when the plug portion is inserted in the socket portion. A flexible tongue is integrally formed with the bottom part, and has apparatus for engaging the locking lug when the plug portion is inserted in the socket portion. Downward pressure on the release button when the plug portion is inserted in the socket portion disengages the aperture from the projecting ledge. Further pressure on the release button causes the tip of the release button to bend the flexible tongue and release the locking lug from the flexible tongue to remove the plug portion from the socket portion.

(7) PCT Patent Application Publication Number WO 2005/013750 A1 to Taka-Hashi.

PCT Patent Application Publication Number WO 2005/013750 A1 published to Taka-Hashi on Feb. 17, 2005 in international class A44B and subclass 11/25 teaches a plug-in type buckle including a male member having a belt mounting frame, a pair of guide levers formed on the belt mounting frame, and an elastic locking piece fitted to the belt mounting frame between the guide levers and having a locking head port formed at the end part thereof and a female member having a belt mounting lever, a locking lever, and a pair of side levers connecting the belt mounting lever to the locking lever. The locking lever forms a part to be locked at the inner edge thereof. An insert part is formed between the side levers and opposed to each other. To guide the guide levers, a pair of guide pieces are formed on the outsides of the side levers. When a locking head part is inserted into the insert part, the guide levers are brought into slidable contact with the guide pieces.

(8) U.S. Pat. No. 6,931,695 B2 to Anscher.

U.S. Pat. No. 6,931,695 B2 issued to Anscher on Aug. 23, 2005 in U.S. class 24 and subclass 614 teaches a buckle including a male portion, a female portion, and a push button. The male portion includes a base and at least one locking leg having a release tab. The female portion includes a hollow body and a catch for locking the locking leg to the female portion when the male portion is inserted into the female portion. The push button is inserted into the female portion and is adapted to move longitudinally toward and away from the male portion. The push button has a base, a spring mounted on an inside surface of the base, and at least one release prong. Depressing the push button causes the release prong to slide between the catch and the release tab and release the release tab from the catch causing the spring to push against the male portion and eject the male portion from the female portion.

(9) United States Patent Application Publication Number US 2007/0214617A1 to Niwa.

United States Patent Application Publication Number US 2007/0214617 A1 published to Niwa on Sep. 20, 2007 in U.S. class 24 and subclass 615 teaches a buckle provided with a female member having first and second engaging portions, and a male member having first and second engagement pieces. By inserting the male member into the female member, the first engaging portion engages with the first engaging piece and the second engaging portion engages with the second engaging piece to thereby connect the female member and the male member. The male member and the female member are not separated unless engagement between the first engaging piece and the first engaging portion, as well as engagement between the second engaging piece and the second engaging portion, are released by way of both a first operating portion and a second operating portion that are separately provided on the front and rear of the female member being pressed inwardly.

It is apparent that numerous innovations for quick-release buckles have been provided in the prior art, which are adapted to be used. Furthermore, even though these innovations may be suitable for the specific individual purposes to which they address, however, they would not be suitable for the purposes of the embodiments of the present invention as heretofore described, namely, a quick-release buckle for a shoulder strap and preventing unintentional release when tension is exerted by the shoulder strap.

2. SUMMARY OF THE INVENTION

Thus, an object of the embodiments of the present invention is to provide a quick-release buckle for a shoulder strap and preventing unintentional release when tension is exerted by the shoulder strap, which avoids the disadvantages of the prior art.

Briefly stated, another object of the embodiments of the present invention is to provide a quick-release buckle for a shoulder strap and preventing unintentional release when tension is exerted by the shoulder strap. The buckle includes a socket member, a plug member, and a locking member. The plug member has the shoulder strap connected thereto, and is replaceably engaged with the socket member. The locking member is an operative part of the socket member. The plug member replaceably engages in the locking member in such a manner so to be released therefrom, the locking member is released and the plug member has to be pulled in a direction opposite to that in which tension is exerted by the shoulder strap so as to prevent the unintentional release of the quick-release buckle when tension is exerted by the shoulder strap, while the tension exerted by the shoulder strap when the plug member is engaged in the locking member assures unintentional release of the quick-release buckle.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

Figure 1:
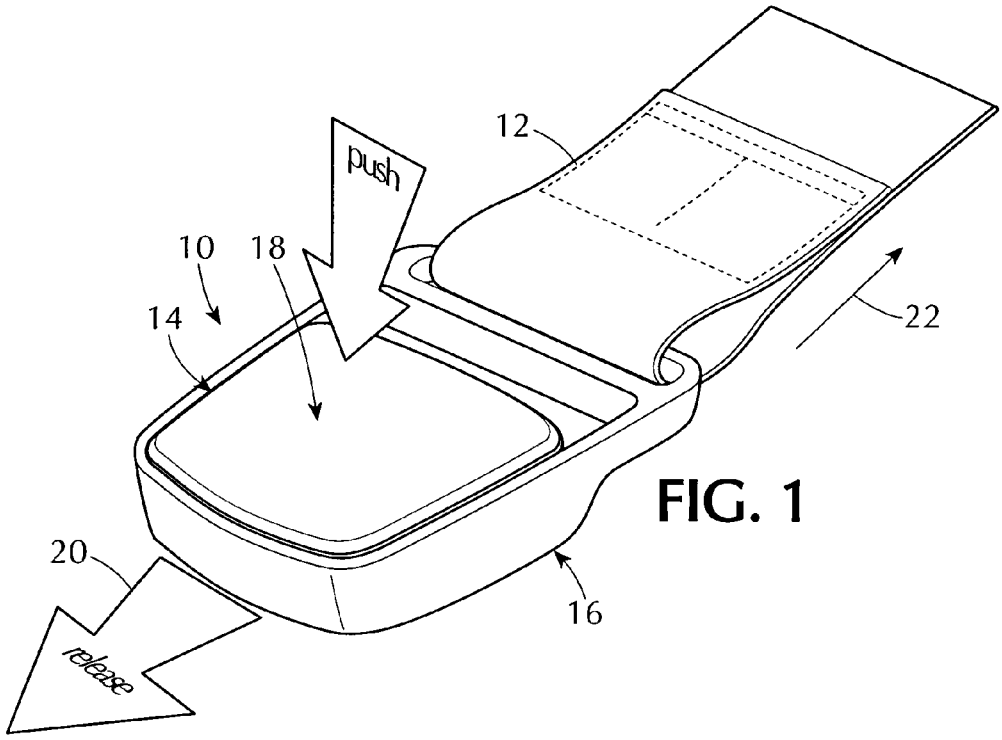
FIG. 1 is a diagrammatic perspective view of the quick-release buckle of the embodiments of the present invention in a latch mode and connected to a shoulder strap and preventing unintentional release when tension is exerted by the shoulder strap.

A. General.

10 quick-release buckle of embodiments of present invention for shoulder strap 12 and preventing unintentional release when tension is exerted by shoulder strap 12

B. Overall Configuration of Quick-Release Buckle 10.

14 socket member

16 plug member

18 locking member

20 direction of pull of plug member 16

22 tension from shoulder strap 12

C. Specific Configuration of Socket Member 14, Plug Member 16, and Locking Member 18.

(1) Specific Configuration of Socket Member 14.

24 housing of socket member 14

26 top of housing 24 of socket member 14

28 front wall of housing 24 of socket member 14

30 pair of side walls of housing 24 of socket member 14

32 rear wall of housing 24 of socket member 14

34 chamber of housing 24 of socket member 14

36 through opening of front wall 28 of housing 24 of socket member 14

38 pair of grooves of pair of side walls 30 of housing 24 of socket member 14, respectively (2) Specific Configuration of Locking Member 18.

40 plate of locking member 18

42 resilient locking piece of plate 40 of locking member 18

44 button of locking member 18

(3) Specific Configuration of Plug Member 16.

46 frame of plug member 16

48 top of frame 46 of plug member 16

50 bottom of frame 46 of plug member 16

52 front wall of frame 46 of plug member 16

54 pair of side walls of frame 46 of plug member 16

56 rear wall of frame 46 of plug member 16

58 tongue of front wall 52 of frame 46 of plug member 16

60 through opening of tongue 58 of front wall 52 of frame 46 of plug member 16

62 pair of ridges of pair of side walls 54 of frame 46 of plug member 16

5. DETAILED DESCRIPTION OF THE PREFERRED EMBODIMENTS

A. General.

Figure 2:
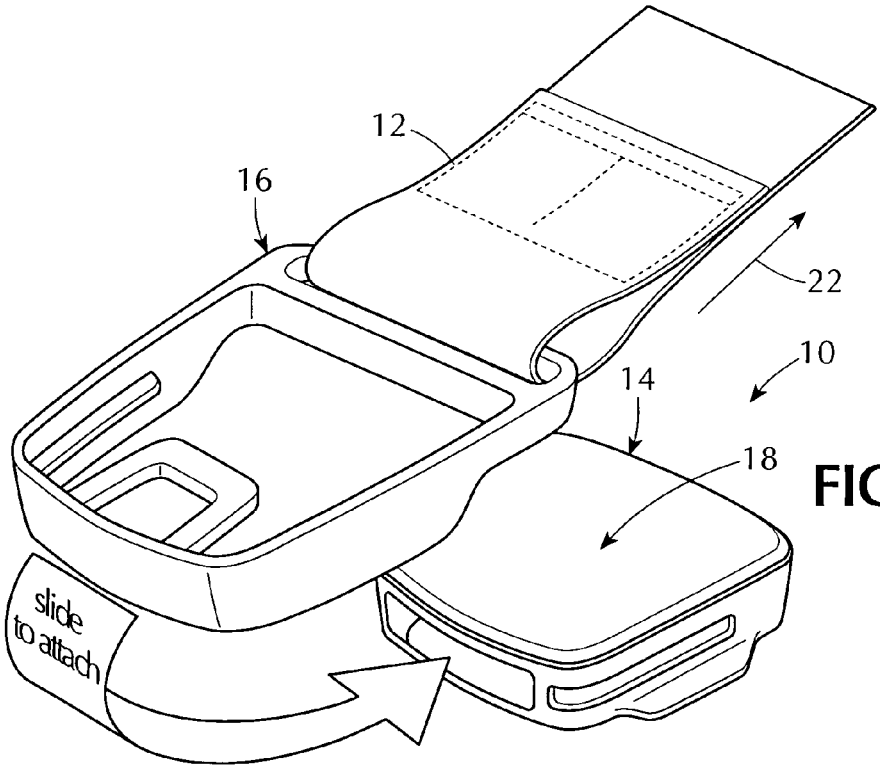
FIG. 2 is a diagrammatic perspective view of the quick-release buckle of the embodiments of the present invention in an unlatch mode and connected to a shoulder strap.

Referring now to the figures, in which like numerals indicate like parts, and particularly to FIGS. 1 and 2, which are, respectively, a diagrammatic perspective view of the quick-release buckle of the embodiments of the present invention in a latch mode and connected to a shoulder strap and preventing unintentional release when tension is exerted by the shoulder strap, and a diagrammatic perspective view of the quick-release buckle of the embodiments of the present invention in an unlatch mode and connected to a shoulder strap, the quick-release buckle of the embodiments of the present invention is shown generally at 10 for a shoulder strap 12 and preventing unintentional release when tension is exerted by the shoulder strap 12.

B. The Overall Configuration of the Quick-Release Buckle 10.

The quick-release buckle 10 comprises a socket member 14, a plug member 16, and a locking member 18. The plug member 16 has the shoulder strap 12 connected thereto and is replaceably engaged with the socket member 14. The locking member 18 is an operative part of the socket member 14. As shown in FIG. 1, the plug member 16 replaceably engages in the locking member 18 in such a manner so to be released therefrom, the locking member 18 is released and the plug member 16 has to be pulled in a direction 20 opposite to that in which tension 22 from the shoulder strap 12 is exerted so as to prevent the unintentional release of the quick-release buckle 10 when tension is exerted by the shoulder strap 12, while, as shown in FIG. 2, the tension 22 exerted by the shoulder strap 12 when the plug member 16 is engaged in the locking member 18 assures unintentional release of the quick-release buckle 10.

C. The Specific Configuration of the Socket Member 14, the Plug Member 16, and the Locking Member 18.

Figure 3:
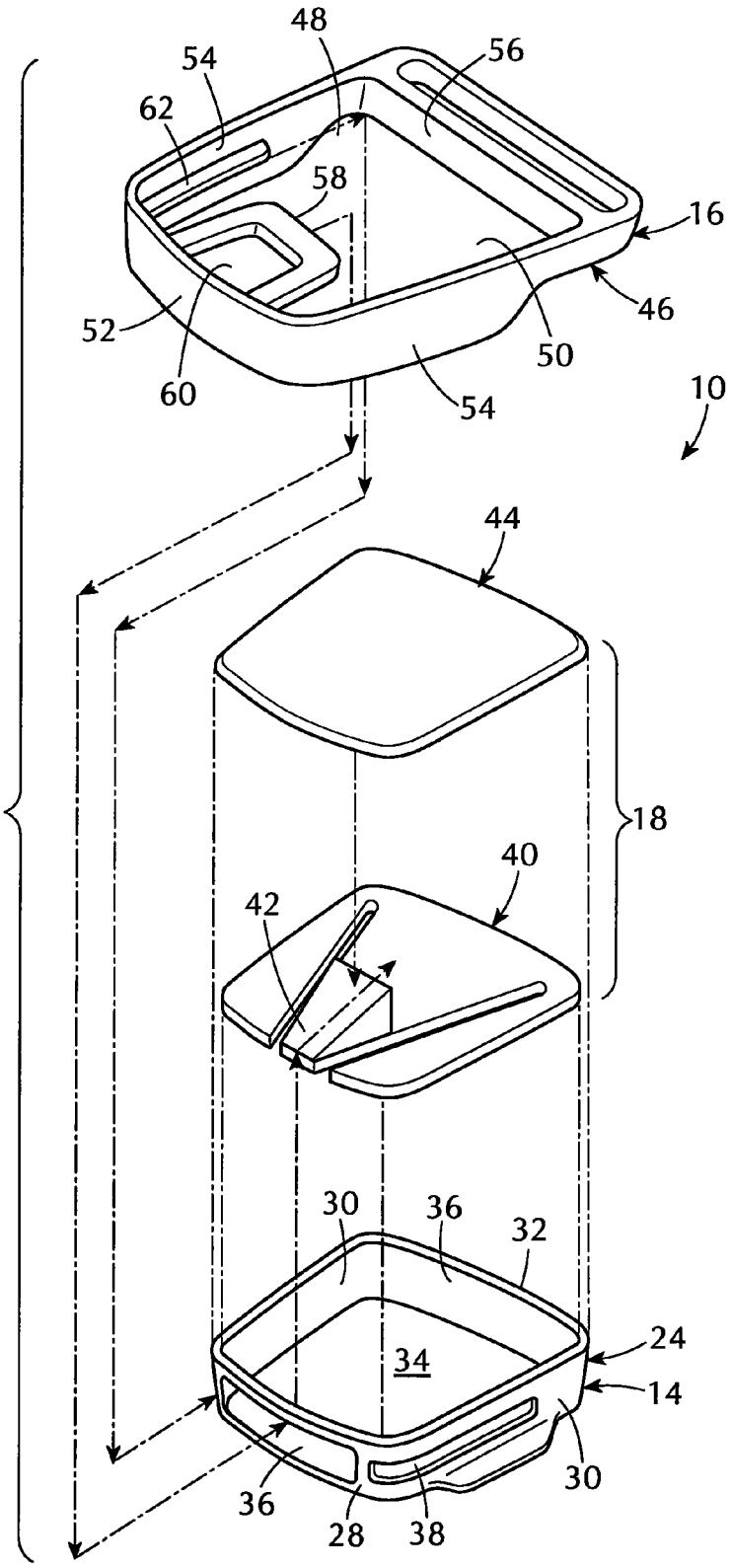
FIG. 3 is an exploded diagrammatic perspective view of the quick-release buckle of the embodiments of the present invention.

The specific configuration of the socket member 14, the plug member 16, and the locking member 18 can best be seen in FIG. 3, which is an exploded diagrammatic perspective view of the quick-release buckle of the embodiments of the present invention, and as such, will be discussed with reference thereto.

(1) The Specific Configuration of the Socket Member 14.

The socket member 14 comprises a housing 24. The housing 24 of the socket member 14 has a top 26, a front wall 28, a pair of side walls 30, a rear wall 32, and contains a chamber 34.

The top 26 of the housing 24 of the socket member 14 is open and communicates with the chamber 34 of the housing 24 of the socket member 14. The front wall 28 of the housing 24 of the socket member 14 has a through opening 36. The through opening 36 of the front wall 28 of the housing 24 of the socket member 14 communicates with the chamber 34 of the housing 24 of the socket member 14.

The pair of side walls 30 of the housing 24 of the socket member 14 have a pair of grooves 38, respectively. The pair of grooves 38 of the pair of side walls 30 of the housing 24 of the socket member 14, respectively, run externally therein, from the front wall 28 of the housing 24 of the socket member 14 to short of the rear wall 32 of the housing 24 of the socket member 14.

(2) The Specific Configuration of the Locking Member 18.

The locking member 18 comprises a plate 40. The plate 40 of the locking member 18 sits in the chamber 34 of the housing 24 of the socket member 14.

The plate 40 of the locking member 18 has a resilient locking piece 42. The resilient locking piece 42 of the plate 40 of the locking member 18 is accessible through the through opening 36 of the front wall 28 of the housing 24 of the socket member 14.

The locking member 18 further comprises a button 44. The button 44 of the locking member 18 closes the top 26 of the housing 24 of the socket member 14, and engages the resilient locking piece 42 of the plate 40 of the locking member 18 to move therewith so as to allow the resilient locking piece 42 of the plate 40 of the locking member 18 to move down when the button 44 of the locking member 18 is depressed.

(3) The Specific Configuration of the Plug Member 16.

The plug member 16 comprises a frame 46. The frame 46 of the plug member 16 is sized and shaped to intimately surround the socket member 14, and has a top 48, a bottom 50, a front wall 52, a pair of side walls 54, and a rear wall 56.

The top 48 of the frame 46 of the plug member 16 is open. The bottom 50 of the frame 46 of the plug member 16 is open and communicates with the top 48 of the frame 46 of the plug member 16.

The front wall 52 of the frame 46 of the plug member 16 has a tongue 58. The tongue 58 of the front wall 52 of the frame 46 of the plug member 16 extends internally therefrom, towards the rear wall 56 of the frame 46 of the plug member 16, and contains a through opening 60. The through opening 60 of the tongue 58 of the front wall 52 of the frame 46 of the plug member 16 is sized and shaped to receive the resilient locking piece 42 of the plate 40 of the locking member 18.

The pair of side walls 54 of the frame 46 of the plug member 16 have a pair of ridges 62, respectively. The pair of ridges 62 of the pair of side walls 54 of the frame 46 of the plug member 16, respectively, run internally thereon, from the front wall 52 of the frame 46 of the plug member 16 to short of the rear wall 56 of the frame 46 of the plug member 16, and are sized and shaped to be slidably received in the pair of grooves 38 of the pair of side walls 30 of the housing 24 of the socket member 14, respectively.

(4) The Method of Latching the Quick-Release Buckle 10.

Figure 4A:
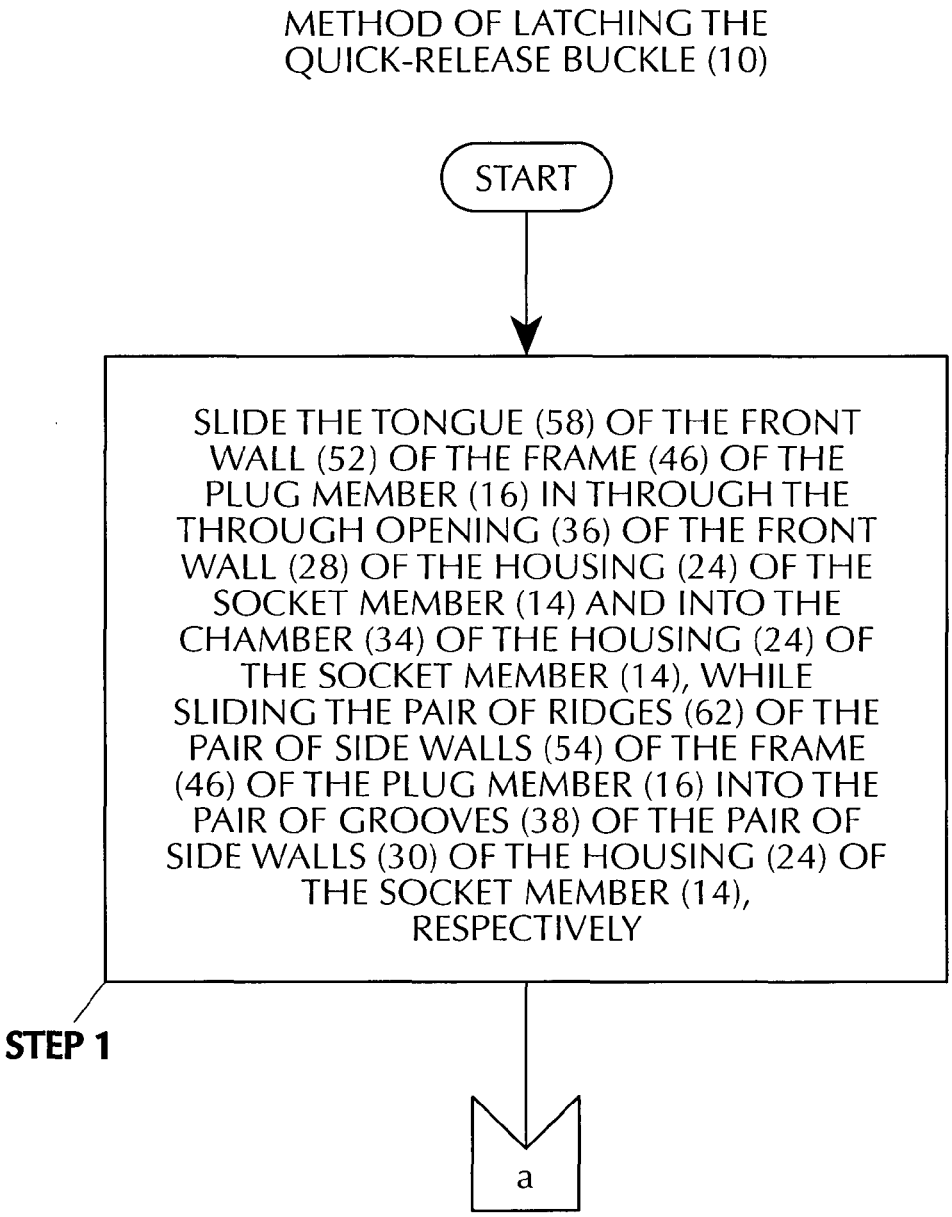
FIGS. 4A-4B are a flowchart of the method of latching the quick-release buckle of the embodiments of the present invention.
Figure 4B:
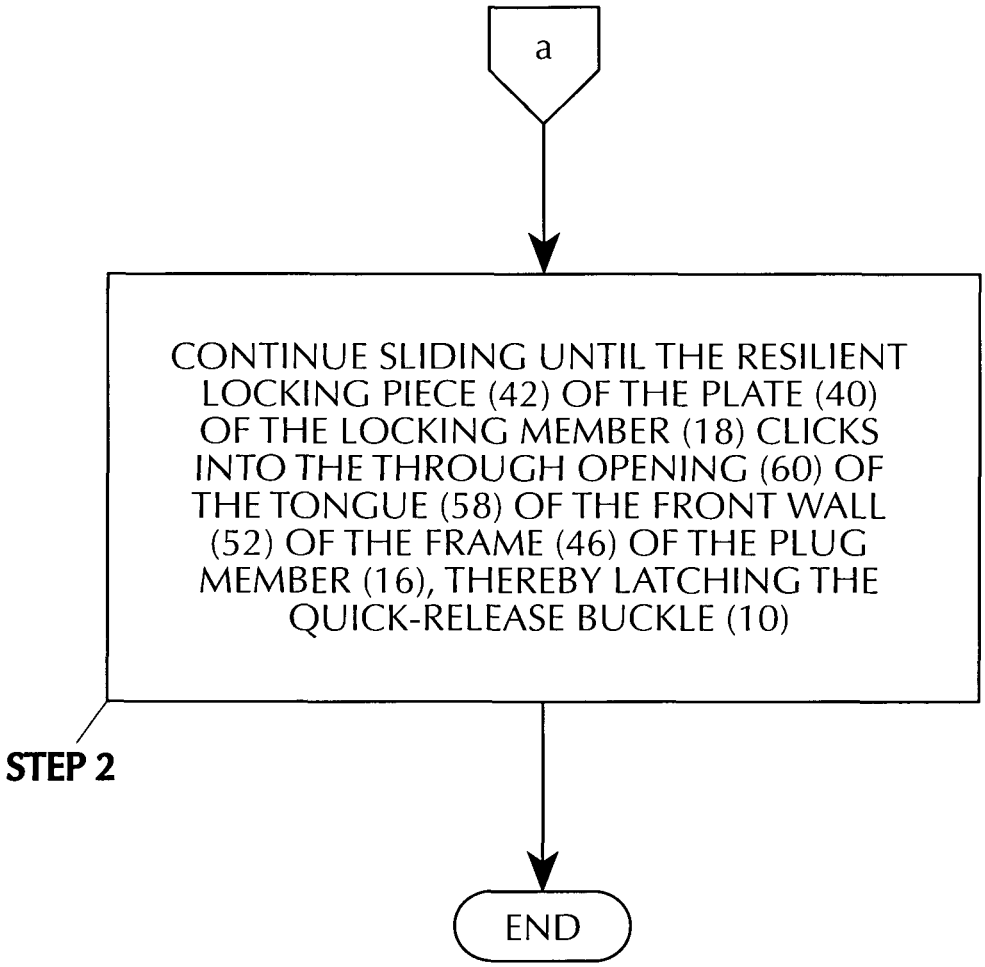

The method of latching the quick-release buckle 10 can best be seen in FIGS. 4A-4B, which are a flowchart of the method of latching the quick-release buckle of the embodiments of the present invention, and as such, will be discussed with reference thereto.

STEP 1: As shown in FIG. 4A, slide the tongue 58 of the front wall 52 of the frame 46 of the plug member 16 in through the through opening 36 of the front wall 28 of the housing 24 of the socket member 14 and into the chamber 34 of the housing 24 of the socket member 14, while sliding the pair of ridges 62 of the pair of side walls 54 of the frame 46 of the plug member 16 into the pair of grooves 38 of the pair of side walls 30 of the housing 24 of the socket member 14, respectively.

STEP 2: As shown in FIG. 4B, continue sliding until the resilient locking piece 42 of the plate 40 of the locking member 18 clicks into the through opening 60 of the tongue 58 of the front wall 52 of the frame 46 of the plug member 16, thereby latching the quick-release buckle 10.

(5) The Method of Unlatching the Quick-Release Buckle 10.

Figure 5A:
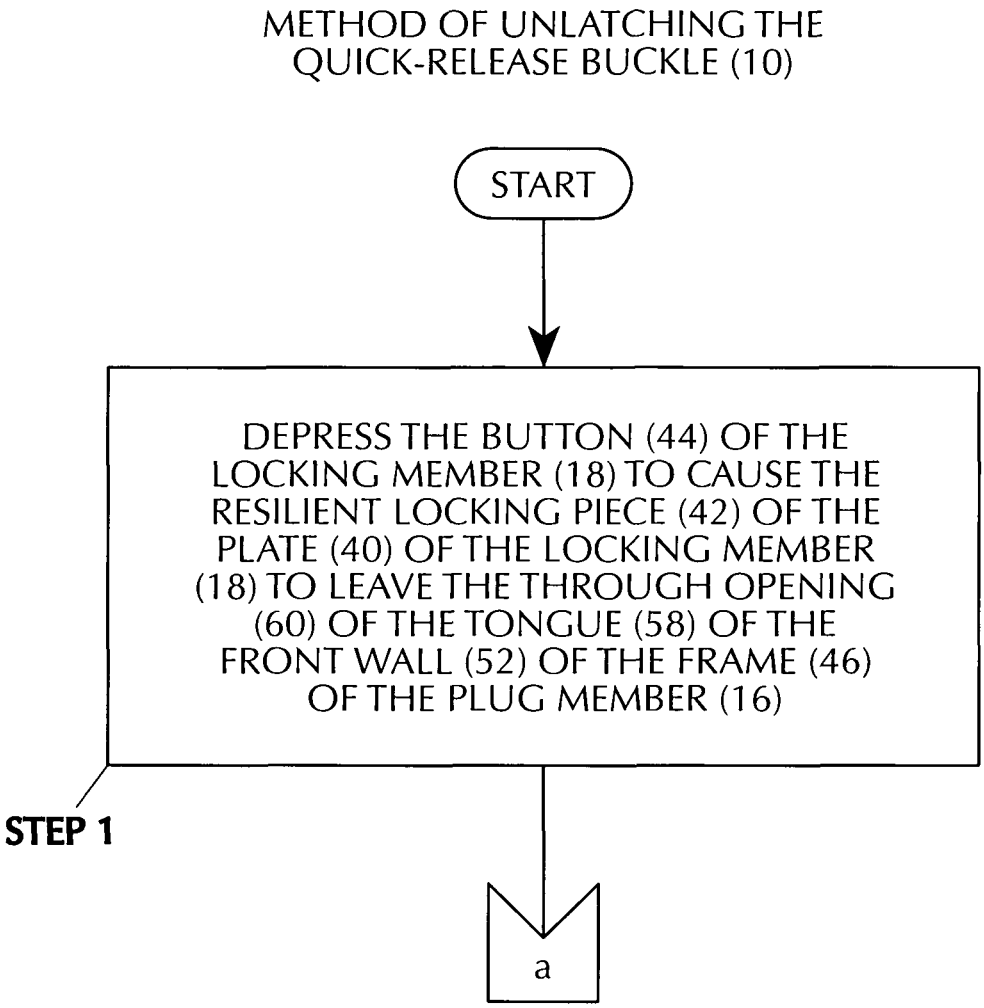
FIGS. 5A-5B are a flowchart of the method of unlatching the quick-release buckle of the embodiments of the present invention.
Figure 5B:
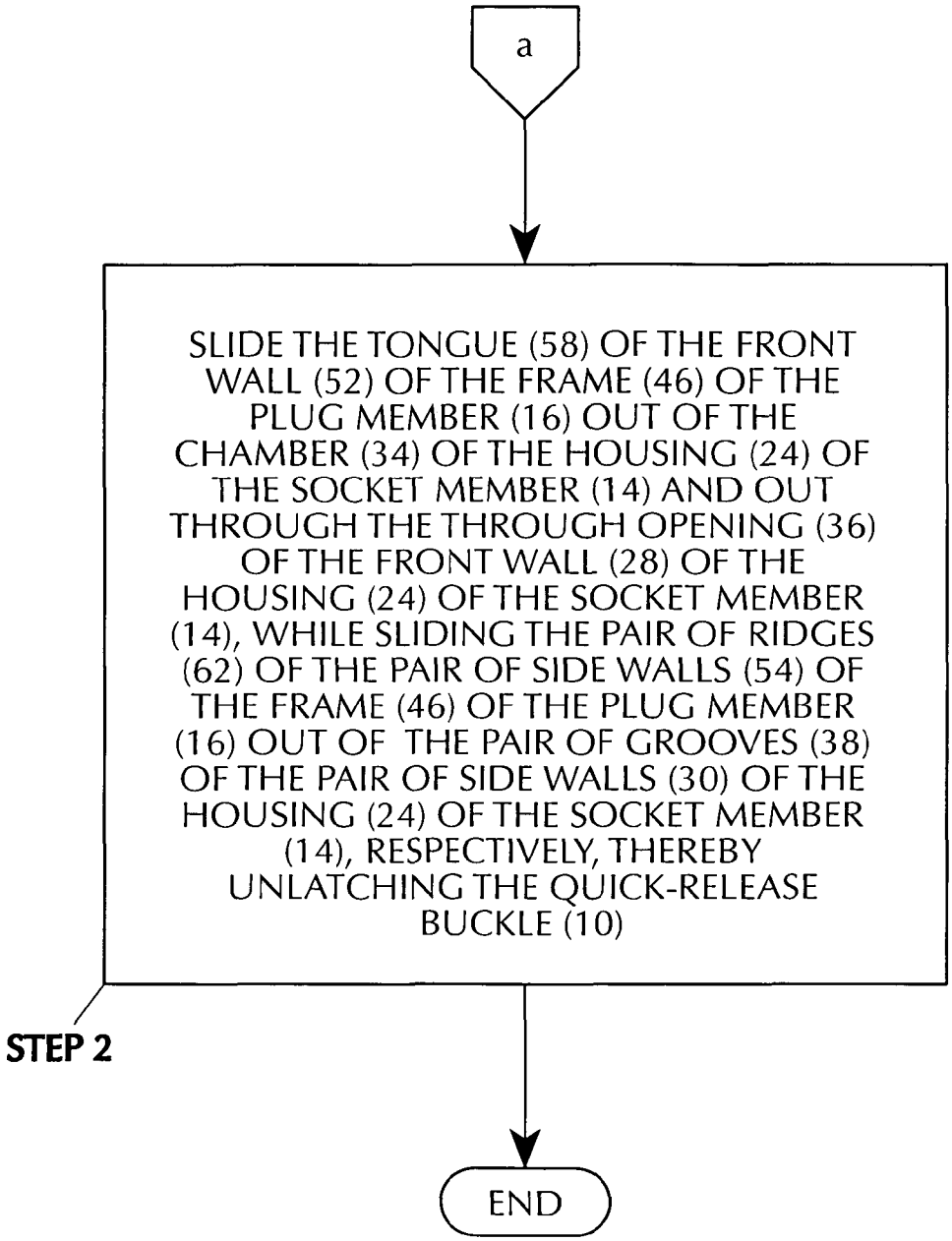

The method of unlatching the quick-release buckle 10 can best be seen in FIGS. 5A-5B, which are a flowchart of the method of unlatching the quick-release buckle of the embodiments of the present invention, and as such, will be discussed with reference thereto.

STEP 1: As shown in FIG. 5A, depress the button 44 of the locking member 18 to cause the resilient locking piece 42 of the plate 40 of the locking member 18 to leave the through opening 60 of the tongue 58 of the front wall 52 of the frame 46 of the plug member 16.

STEP 2: As shown in FIG. 5B, slide the tongue 58 of the front wall 52 of the frame 46 of the plug member 16 out of the chamber 34 of the housing 24 of the socket member 14 and out through the through opening 36 of the front wall 28 of the housing 24 of the socket member 14, while sliding the pair of ridges 62 of the pair of side walls 54 of the frame 46 of the plug member 16 out of the pair of grooves 38 of the pair of side walls 30 of the housing 24 of the socket member 14, respectively, thereby unlatching the quick-release buckle 10.

D. Impressions.

It will be understood that each of the elements described above or two or more together may also find a useful application in other types of constructions differing from the types described above.

While the embodiments of the present invention have been illustrated and described as embodied in a quick-release buckle for a shoulder strap and preventing unintentional release when tension is exerted by the shoulder strap, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A quick-release buckle for a shoulder strap and preventing unintentional release when tension is exerted by the shoulder strap, comprising:

a socket member attached to a locking member, the socket member comprising a housing comprising a front wall, a rear wall, and a pair of side walls, the pair of side walls comprising a pair of grooves running externally from the front wall to a position between the rear wall and the front wall;

a plug member adapted to prevent unintentional release of the quick release buckle when the tension is exerted by the shoulder strap, the plug member replaceably engaged with the socket member and the locking member, the plug member adapted to be released from the socket member by releasing the locking member and pulling the plug member in a direction opposite the tension exerted by the shoulder strap.

2. The buckle of claim 1, wherein the housing has a top; and wherein the housing contains a chamber.

3. The buckle of claim 2, wherein the top is open; and wherein the top communicates with the chamber.

4. The buckle of claim 2, wherein the front wall has a through opening; and wherein the through opening communicates with the chamber.

5. The buckle of claim 4, wherein the locking member comprises a plate; and wherein the plate sits in the chamber.

6. The buckle of claim 5, wherein the plate has a resilient locking piece; and wherein the resilient locking piece is accessible through the through opening of the front wall.

7. The buckle of claim 6, wherein the locking member comprises a button;

wherein the button closes the top; and wherein the button engages the resilient locking piece to move therewith so as to allow the resilient locking piece to move down when the button is depressed.

8. The buckle of claim 6, wherein the plug member comprises a frame;

wherein the frame is sized and shaped to intimately surround the socket member; wherein the frame has a top, a bottom, a front wall, a pair of side walls, and a rear wall.

9. The buckle of claim 8, wherein the top of the frame is open;

wherein the bottom of the frame is open; and wherein the bottom of the frame communicates with the top of the frame.

10. The buckle of claim 8, wherein the front wall of the frame has a tongue extending internally therefrom towards the rear wall of the frame.

11. The buckle of claim 10, wherein the tongue has a through opening sized and shaped to receive the resilient locking piece.

12. The buckle of claim 8, wherein the pair of side walls of the frame have a pair of ridges running internally thereon, from the front wall of the frame to a position between the front wall of the frame and the rear wall of the frame; and wherein the pair of ridges are sized and shaped to be slidably received in the pair of grooves.

* * * * *